US007726949B2

(12) United States Patent
Taguchi

(10) Patent No.: US 7,726,949 B2
(45) **Date of Patent: *Jun. 1, 2010**

(54) VARIABLE DISPLACEMENT COMPRESSOR

(75) Inventor: Yukihiko Taguchi, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 729 days.

This patent is subject to a terminal disclaimer.

(21) Appl. No.: 10/510,342

(22) PCT Filed: Apr. 8, 2003

(86) PCT No.: PCT/JP03/04441

§ 371 (c)(1),
(2), (4) Date: Oct. 5, 2004

(87) PCT Pub. No.: WO03/085260

PCT Pub. Date: Oct. 16, 2003

(65) Prior Publication Data

US 2005/0163624 A1 Jul. 28, 2005

(30) Foreign Application Priority Data

Apr. 9, 2002 (JP) ..... 2002-106461

(51) Int. Cl.
*F04B 1/26* (2006.01)

(52) U.S. Cl. ..... 417/222.2; 417/269

(58) Field of Classification Search ..... 417/222.2, 417/270, 269; 62/228.5
See application file for complete search history.

(56) References Cited

U.S. PATENT DOCUMENTS 4,780,059 A 10/1988 Taguchi
4,878,817 A 11/1989 Kikuchi et al.
4,882,909 A 11/1989 Terauchi
4,936,752 A 6/1990 Terauchi
5,025,636 A 6/1991 Terauchi
5,027,612 A 7/1991 Terauchi (Continued)

FOREIGN PATENT DOCUMENTS

EP 1127721 8/2001

(Continued)

*Primary Examiner*—Devon C Kramer
*Assistant Examiner*—Leonard J Weinstein
(74) *Attorney, Agent, or Firm*—Baker Botts, LLP.

(57) ABSTRACT

A variable displacement compressor capable of controlling a piston stroke by openably controlling a displacement control valve to regulate a pressure in a crank chamber, comprising the displacement control valve disposed in a passageway from a discharge chamber to the crank chamber, and a fixed orifice provided in a passageway from the crank chamber to a suction chamber, the displacement control valve further comprising a pressure sensing member for the pressure in the suction chamber or the crank chamber, a valve element having a valve part opened and closed in response to the operation of the pressure sensing member, a valve chamber for disposing the valve part therein and allowing the pressure in the crank chamber to act therein, a partition wall disposed around the valve element, a pressure chamber partitioned from the valve chamber by the partition wall and allowing the pressure in the suction chamber to act therein, and a solenoid provided to the other end of the valve element, wherein a flow passage of non-contact structure is formed in the partition wall, and the number of sliding parts is reduced to lower a sliding resistance.

5 Claims, 4 Drawing Sheets

U.S. PATENT DOCUMENTS

| | | | | |
|---|---|---|---|---|
| 5,092,741 | A | 3/1992 | Taguchi | |
| 5,094,589 | A | 3/1992 | Terauchi et al. | |
| 5,145,325 | A | 9/1992 | Terauchi | |
| 5,145,326 | A | 9/1992 | Kimura et al. | |
| 5,165,863 | A | 11/1992 | Taguchi | |
| 5,168,716 | A | 12/1992 | Terauchi | |
| 5,205,718 | A | 4/1993 | Fujisawa et al. | |
| 5,332,365 | A * | 7/1994 | Taguchi | 417/222.2 |
| 5,588,807 | A | 12/1996 | Kimura et al. | |
| 6,102,670 | A | 8/2000 | Taguchi | |
| 6,138,468 | A | 10/2000 | Yokomachi | |
| 6,149,397 | A | 11/2000 | Mizutani et al. | |
| 6,152,845 | A | 11/2000 | Okada et al. | |
| 6,164,925 | A | 12/2000 | Yokomachi et al. | |
| 6,196,808 | B1 | 3/2001 | Taguchi | |
| 6,213,727 | B1 | 4/2001 | Kawaguchi | |
| 6,224,348 | B1 | 5/2001 | Fukanuma | |
| 6,350,106 | B1 | 2/2002 | Shimizu et al. | |
| 6,368,070 | B1 | 4/2002 | Takai | |
| 6,373,677 | B1 | 4/2002 | Ikeda | |
| 6,443,708 | B1 * | 9/2002 | Hirota | 417/222.2 |
| 6,684,655 | B2 | 2/2004 | Terauchi | |
| 6,939,112 | B2 * | 9/2005 | Taguchi | 417/222.2 |
| 2001/0003573 | A1 * | 6/2001 | Kimura et al. | 417/222.2 |
| 2002/0182087 | A1 | 12/2002 | Okii et al. | |
| 2003/0190238 | A1 | 10/2003 | Takai | |
| 2003/0202885 | A1 | 10/2003 | Taguchi | |
| 2005/0034469 | A1 | 2/2005 | Ochiai | |
| 2005/0163624 | A1 | 7/2005 | Taguchi | |

FOREIGN PATENT DOCUMENTS

| | | |
|---|---|---|
| EP | 1167759 | 1/2002 |
| EP | 1172559 | 1/2002 |
| JP | 02011869 | 1/1990 |
| JP | 06173851 | 6/1994 |
| JP | 11107929 | 4/1999 |
| JP | 2000/018172 | 1/2000 |
| JP | 2000/158939 | 6/2000 |
| JP | 2000/283028 | 10/2000 |
| JP | 2001/133053 | 5/2001 |
| JP | 2002/070730 | 3/2002 |

* cited by examiner

RELATED ART

VARIABLE DISPLACEMENT COMPRESSOR

TECHNICAL FIELD OF THE INVENTION

The present invention relates to a variable displacement compressor used in an air conditioning system for vehicles, etc., and specifically to a variable displacement compressor capable of allowing a smooth operation of a displacement control valve at a high reliability and capable of simplifying the processing of the compressor as a whole.

BACKGROUND ART OF THE INVENTION

As a variable displacement compressor provided in a refrigeration circuit of an air conditioning system for vehicles, etc., a compressor such as one disclosed in JP-A-11-107929 is known. To this variable displacement compressor, in order to control its displacement for discharge, a displacement control valve is provided, in which a control point for a pressure in a suction chamber is decided to be one-to-one relative to an amount of electricity applied to an electromagnetic actuator, and which can maintain the variable displacement compressor forcibly at a minimum displacement condition when it is not excited.

This displacement control valve is structured as depicted in FIG. 4, and it comprises a valve casing 111, a bellows 112 as a pressure sensing member for sensing a pressure in a suction chamber or a crank chamber which is disposed in valve casing 111 and in which a spring 112*a* is disposed at a vacuum condition therein, a guide 113 receiving the lower end of bellows 112 and supported movably by valve casing 111, a spring 114 urging guide 113 upward, an adjustment screw 115 forming a part of valve casing 111 for adjusting an amount of expansion/contraction of bellows 112, a transmission rod 116 being brought into contact with the upper end of bellows 112 and supported movably by valve casing 111, a valve element 118 being brought into contact with the other end of transmission rod 116 and opening and closing a communication passage 117 between a discharge chamber and the crank chamber of the variable displacement compressor in response to the expansion/contraction of bellows 112, and an electromagnetic coil 121 generating an electromagnetic force for urging valve element 118 in its valve opening direction via a plunger 119 slid in a housing 110 and a transmission rod 120 slid in a fixed iron core 121*a*.

Further, a surface 118*b* of valve element 118 opposite to a contact surface 118*a* being brought into contact with the valve seat is formed so as to receive a pressure in a crank chamber through a pressure guiding passage 122. A pressure receiving area for a pressure in a crank chamber of contact surface 118*a* side of valve element 118 and a pressure receiving area for a pressure in a crank chamber of surface 118*b* opposite thereto are set at almost the same area. Further, a side surface 118*c* of valve element 118 is supported movably by valve casing 111, a gap between the side surface 118*c* and the inner circumferential surface of valve casing 111 is set very small, and in this portion, valve element 118 is substantially slid in its axial direction.

In the above-described mechanism of the displacement control valve of the variable displacement compressor, although a pressure in a crank chamber is controlled by moving and controlling valve element in its axial direction, thereby controlling the displacement for discharge, totally four sliding parts between transmission rod 116 and valve casing 111, between side surface 118*c* of valve element 118 and valve casing 111, between transmission rod 120 and fixed iron core 121*a* and between plunger 119 and housing 110 are present in this mechanism for movement and control in the axial direction of valve element 118. Therefore, when valve element 118 is moved and controlled in its axial direction, because there occur sliding resistances in the respective sliding parts, if these sliding resistances are great, there is a fear to deteriorate the movement of valve element 118. Moreover, because four sliding parts are arranged in the same axial direction, it may be difficult to maintain the respective sliding parts accurately at respective predetermined positional relationships without shifting, and also from this point of view, there is a fear to enlarge the sliding resistance. If the movement of valve element 118 is deteriorated by such a sliding resistance, a smooth control of displacement for discharge of the variable displacement compressor may be damaged.

DISCLOSURE OF THE INVENTION

Accordingly, an object of the present invention is to provide a variable displacement compressor which can reduce a sliding resistance accompanying with the movement of a valve element of a displacement control valve, thereby controlling displacement for discharge smoothly.

Another object of the present invention is to provide a structure wherein, in addition to the above-described structure for reducing the sliding resistance, it is possible to form a fixed orifice, which has been formed at a cylinder block side or the vicinity thereof and provided at a position in a pressure relief passageway communicating from a crank chamber to a suction chamber, in a displacement control valve, thereby simplifying the processing, in particular, simplifying the processing of the cylinder block side.

To achieve the above objects, a variable displacement compressor according to the present invention has a discharge chamber, a suction chamber and a crank chamber, the compressor comprises a displacement control valve disposed at a position in a discharge pressure supply passageway capable of communicating with the crank chamber from the discharge chamber, and a fixed orifice provided at a position in a pressure relief passageway communicating with the suction chamber from the crank chamber, the displacement control valve is controlled in opening/closing operation to regulate a pressure in the crank chamber to control a piston stroke, wherein the displacement control valve further comprises a pressure sensing member being expanded and contracted by sensing a pressure in the suction chamber or the crank chamber, a valve element one end of which is brought into contact with the pressure sensing member and which has a valve part opening and closing a valve hole formed in the discharge pressure supply passageway in response to an expansion/contraction of the pressure sensing member, a valve chamber in which the valve part is disposed and to which a pressure in the crank chamber acts, a partition wall disposed around the valve element at a position in an axial direction of the valve element, a pressure chamber which is partitioned from the valve chamber by the partition wall and to which a pressure in the suction chamber acts, and a solenoid provided to the other end of the valve element and capable of controlling an opening degree of the valve part by increase/decrease of an electromagnetic force, and a flow passage from the valve chamber to the pressure chamber is formed in a portion disposed with the partition wall, whereby a gap is defined for forming a non-contact structure which does not give a sliding resistance relative to a movement of the valve element in its axial direction.

Namely, in this structure, a conventional sliding part having been present in the portion of the partition wall is abolished, and a gap with a non-contact structure is formed and this gap is positively utilized as a flow passage from the valve chamber to the pressure chamber. By this structure, the number of the conventional four sliding parts as aforementioned can be surely reduced by at least one.

In this variable displacement compressor, the above-described gap may be formed as the fixed orifice, and by this, the fixed orifice may be formed in the displacement control valve and it is not necessary to form it at another portion.

Further, the above-described partition wall may be fixed at a valve casing side of the displacement control valve, and the above-described gap may be defined between an inner circumferential surface of the partition wall and an outer circumferential surface of the valve element. Alternatively, the partition wall may be fixed to the valve element, and the gap may be defined between an outer circumferential surface of the partition wall and an inner circumferential surface of a valve casing of the displacement control valve.

Moreover, it is preferred to employ a structure wherein the solenoid comprises an electromagnetic coil excited for generating an electromagnetic force, a fixed iron core for generating a magnetic force by excitation of the electromagnetic coil, and a plunger attracted and moved to fixed iron core side by the magnetic force of the fixed iron core, and in this structure, the other end of the valve element is fixed to the plunger, the plunger is held slidably in an axial direction of the valve element, and a gap is defined between the fixed iron core and the valve element for forming a non-contact structure which does not give a sliding resistance relative to a movement of the valve element in its axial direction. By this, the sliding parts present in the respective portions of the fixed iron core and the plunger in the aforementioned conventional structure may become only a sliding part of the plunger. Therefore, in this structure, the number of the conventional four sliding parts becomes totally two, namely, the sliding parts in the axially extending portion of the valve element including the plunger become only two sliding parts at both end portions (two-point suspension), and even from the viewpoint of the principle of supporting mechanism, a smooth operation of the movement of the valve element may be assured.

Thus, in the variable displacement compressor according to the present invention, since a non-contact gap structure is formed at a portion of the partition wall and generation of a sliding resistance is prevented at this portion, and the number of sliding parts may be reduced also in the solenoid side, the sliding resistance accompanying with the movement of the valve element may be greatly reduced, and a stable and smooth control of displacement for discharge may be achieved by the smooth operation of the valve element.

Further, because the gap in the partition wall may be formed as the fixed orifice, it becomes unnecessary to provide the fixed orifice at another portion of the compressor, thereby simplifying the processing of the cylinder block and its vicinity portion and reducing the cost as a whole.

THE BEST MODE FOR CARRYING OUT THE INVENTION

Hereinafter, desirable embodiments of the present invention will be explained referring to figures.

Figure 1:
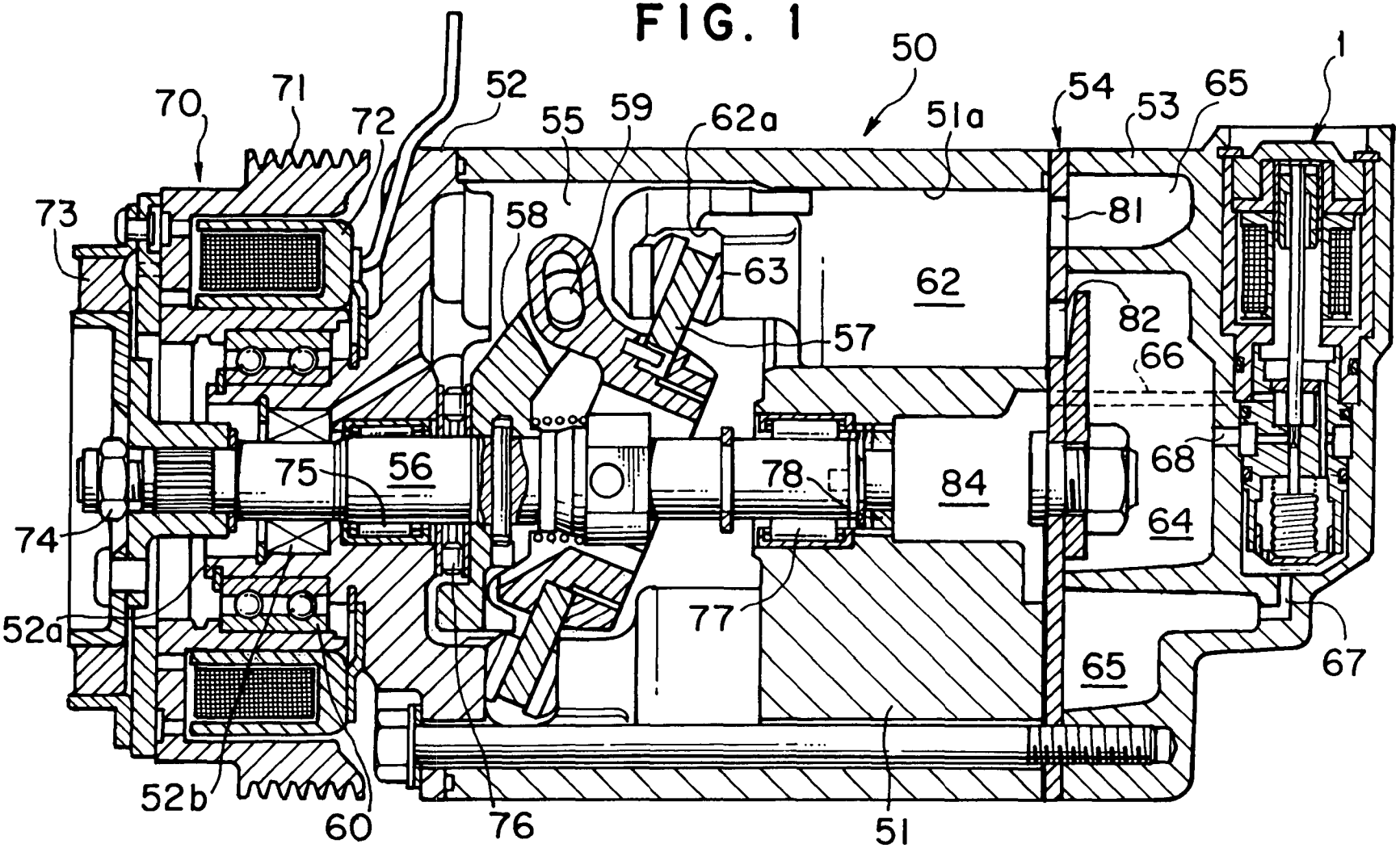
FIG. 1 is a vertical sectional view of a variable displacement compressor according to a first embodiment of the present invention.

In FIG. 1, a variable displacement compressor 50 has a cylinder block 51 with a plurality of cylinder bores 51*a*, a front housing 52 provided at one end of cylinder block 51, and a rear housing 53 provided to cylinder block 51 via a valve plate device 54. A compressor main shaft 56 is provided as a drive shaft across a crank chamber 55 formed by cylinder block 51 and front housing 52, and an inclined plate 57 is disposed around a central portion of the compressor main shaft. Inclined plate 57 connects a rotor 58 fixed to compressor main shaft 56 and a connecting portion 59.

One end of compressor main shaft 56 extends to an outside through a boss 52*a* protruded toward an outside of front housing 52, and an electromagnetic clutch 70 is provided around the boss 52*a* via a bearing 60. Electromagnetic clutch 70 comprises a rotor 71 provided around boss 52*a*, a magnet unit 72 contained in the rotor 71, and a clutch plate 73 provided on one outer end surface of the rotor 71. One end of compressor main shaft 56 is connected to clutch plate 73 via a fastener 74 such as a bolt. A seal member 52*b* is inserted between compressor main shaft 56 and boss 52*a*, thereby isolating between the inside and the outside. Further, the other end of compressor main shaft 56 is present in cylinder block 51, and it is supported by a supporting member 78. Where, labels 75, 76 and 77 indicate bearings, respectively.

A piston 62 is inserted free to be slid into cylinder bore 51*a*. The periphery of inclined plate 57 is disposed in a recessed portion 62*a* formed at the inside of one end of piston 62, and by forming a structure for engaging piston 62 and inclined plate 57 to each other via a pair of shoes 63, the rotational movement of inclined plate 57 is transformed into the reciprocating movement of piston 62.

A suction chamber 65 and a discharge chamber 64 are formed in rear housing 53 separately from each other. Suction chamber 65 can communicate with cylinder bore 51*a* via a suction port 81 provided on valve plate device 54 and a suction valve (not shown), and discharge chamber 64 can communicate with cylinder bore 51*a* via a discharge port 82 provided on valve plate device 54 and a discharge valve (not shown). Crank chamber 55 communicates with a gas chamber 84 formed at a shaft end extended portion of compressor main shaft 56, through a gap between compressor main shaft 56 and bearing 77.

A displacement control valve 1 is provided in a recessed portion of a rear wall of rear housing 53 in this variable displacement compressor 50. This displacement control valve 1 is used for controlling a displacement for discharge (displacement for compression, that is, a stroke of piston 62). Displacement control valve 1 is provided at a portion in the discharge pressure supply passageway capable of communicating from discharge chamber 64 to crank chamber 55, and a part of this discharge pressure supply passageway is formed from a communication passage 66 to gas chamber 84 and a communication passage 68 to discharge chamber 64. Further, a pressure relief passageway communicating from crank chamber 55 to suction chamber 65 is provided, and a part thereof is formed from a communication passage 67.

Figure 2:
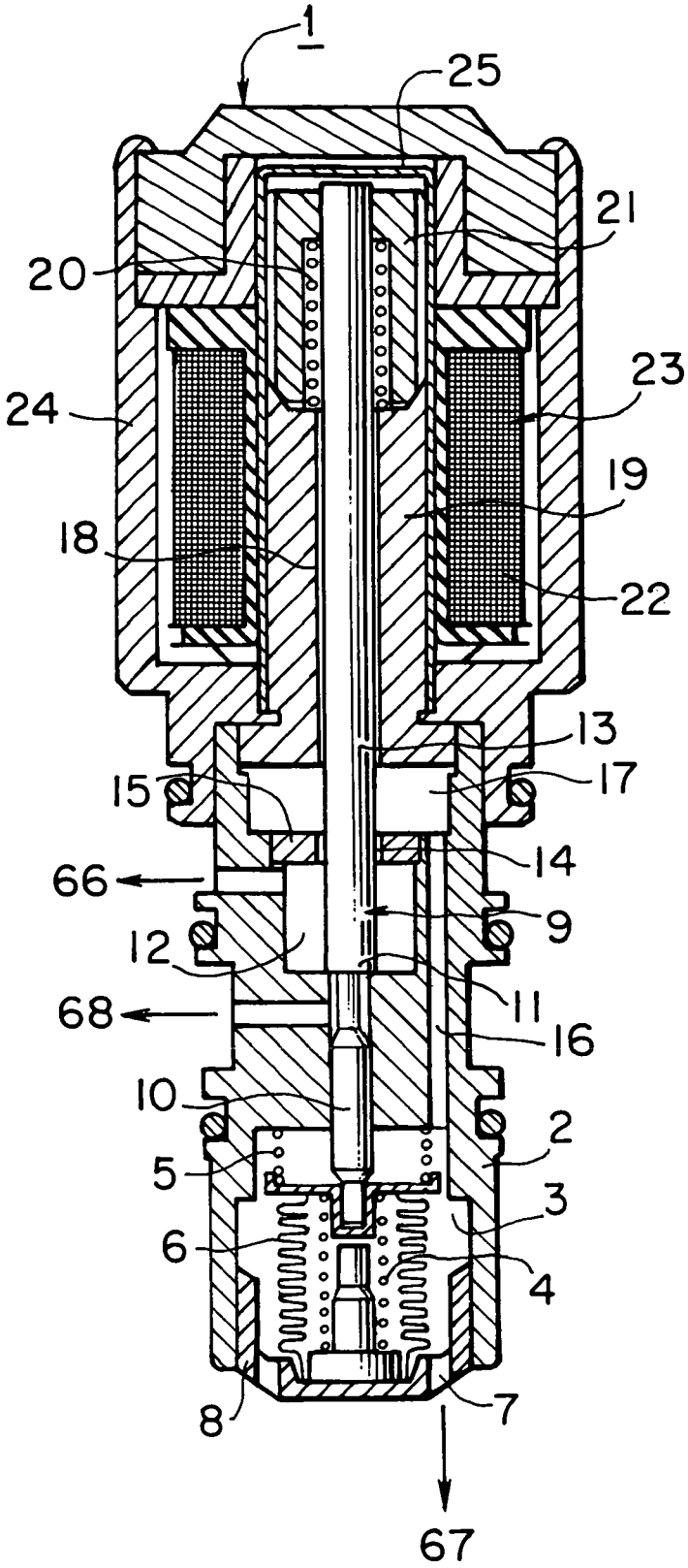
FIG. 2 is an enlarged vertical sectional view of a portion of a displacement control valve of the variable displacement compressor depicted in FIG. 1.

As depicted in FIG. 2, displacement control valve 1 comprises a valve casing 2; a bellows 6 as a pressure sensing means for sensing a suction pressure which is disposed in a pressure sensing chamber 3 formed in valve casing 2, the inside of which is set at a vacuum condition and to which springs 4 and 5 are disposed at inside and outside positions thereof; an adjusting member 8 adjusting an amount of expansion/contraction of bellows 6, forming a part of valve casing 2 and provided with holes 7 communication with communication passage 67 to suction chamber 65; a transmission rod 10 of valve element 9 one end of which is brought into contact with the upper end in the figure of bellows 6 and which is supported slidably by valve casing 2; a valve part 11 which is formed integrally with transmission rod 10 at the upper portion in the figure of transmission rod 10 and which opens and closes communication passages 68 and 66 communicating between discharge chamber 64 and crank chamber 55 of variable displacement compressor 50 in response to the expansion/contraction of bellows 6; a valve chamber 12 in which valve part 11 is disposed; a partition wall 15 through which a transmission rod 13 at the other end of valve element 9 is disposed with a gap 14 with a non-contact structure giving no sliding resistance and which is fixed to valve casing 2; a pressure chamber 17 formed separately at a position opposite to valve chamber 12 via partition wall 15 and communicated to pressure chamber 3 side (suction pressure side) through a communication passage 16; and a solenoid 23. In the portion of solenoid 23, a further extended portion of transmission rod 13 of valve element 9 is inserted into a fixed iron core 19 with a gap 18 of non-contact structure giving no sliding resistance, and a plunger 21 urged by a spring 20 in a direction separate from fixed iron core 19 and fixed to the other end of valve element 9 and an electromagnetic coil 22 excited for generating an electromagnetic force are provided. Solenoid 23 controls the movement of plunger 21 and valve element 9 by increasing and decreasing the magnetic force of fixed iron core 19, which is generated by the electromagnetic force due to the excitation of electromagnetic coil 22, by adjusting the electromagnetic force, and by controlling the attraction force applied to plunger 21 in the axial direction of the valve element due to the magnetic force of fixed iron core 19. Plunger 21 and fixed iron core 19 are contained in a tubular member 25 provided in housing 24, and although iron core 19 is fixed, plunger 21 is supported slidably in the axial direction of the valve element. The above-described gap 14 formed between the inner circumferential surface of partition wall 15 and the outer circumferential surface of valve element 9 in the portion of partition wall 15 forms a fixed orifice.

A pressure in crank chamber 55 acts in valve chamber 12, a pressure in suction chamber 65 acts on bellows 6, and the pressure in suction chamber 65 acts also in pressure chamber 17 through pressure sensing chamber 3 and communication passage 16. Further, valve part 11 of valve element 9 controls to open and close the discharge pressure supply passageway communicating from discharge chamber 64 to crank chamber 55 (valve chamber 12) on the way of the passageway. Furthermore, gap 14 in partition wall 15 forms a fixed orifice provided on the way of the pressure relief passageway communicating from crank chamber 55 (valve chamber 12) to suction chamber 65 side (pressure chamber 17 side). Where, the discharge pressure from each of communication passages 66, 68 acting on either side transmission rod 10 of valve element 9 cancel each other out, and as a result, the discharge pressure does not substantially influence the movement in the axial direction of valve element 9. Therefore, valve element 9 is controlled in opening/closing operation substantially in response to the electromagnetic force and the pressure in the suction chamber acting on bellows 6.

In the above-described variable displacement compressor 50 having displacement control valve 1, when a predetermined current is applied to electromagnetic coil 22, an electromagnetic force acts to the surfaces facing to each other of plunger 21 and fixed iron core 19, and a force attracting plunger 21 toward fixed iron core 19 (a force in the valve closing direction) acts. When this electromagnetic force becomes higher than a certain level, valve part 11 is closed, and the communication between discharge chamber 64 and crank chamber 55 is interrupted. By this, the gas in discharge chamber 64 is not introduced into crank chamber 55, and a gas flow occurs from crank chamber 55 toward suction chamber 65 through fixed orifice (gap 14). Because this fixed orifice has a diameter necessary and enough to flow a blowby gas, which generates when piston 62 compresses the gas, to suction chamber 65 side, the pressure in crank chamber 55 reduces to become substantially the same pressure as that in suction chamber 65, and the compressor is maintained at a maximum displacement and the pressure in suction chamber 65 is gradually reduced.

When the pressure in suction chamber 65 is reduced down to a predetermined value, because bellows 6 expands and valve element 9 operates in its opening direction, the gas in discharge chamber 64 is introduced into crank chamber 55 side, and the displacement for discharge is decreased by increase of a pressure difference between crank chamber 55 and suction chamber 65. By this, when the pressure in suction chamber 65 increases, because bellows 6 contracts and valve element 9 operates in its closing direction, the pressure in crank chamber 65 is reduced, and the displacement for discharge is increased by decrease of a pressure difference between crank chamber 55 and suction chamber 65. Thus, in a case of a constant electromagnetic force, the opening degree of valve element 9 is adjusted so that the pressure in the suction chamber becomes a predetermined value, and the displacement for discharge is controlled.

In the above-described displacement control, because gap 14 formed at the through portion of valve element 9 in partition wall 15 is formed as a flow passage, a non-contact structure may be easily formed between valve element 9 and partition wall 15 by setting a large clearance in this portion, and a sliding resistance is not generated in this portion. Further, in this embodiment, because gap 18 with a non-contact structure for giving no sliding resistance is formed also between transmission rod 13 of valve element 9 and fixed iron core 19, a sliding resistance is not generated also in this portion. Therefore, valve element 9 is supported movably by totally two sliding parts of a lower-end side sliding part between valve casing 2 and transmission rod 10 and an upper-end side sliding part between plunger 21 fixed to valve element 9 and tubular member 25. The number of sliding parts is greatly reduced as compared with totally four sliding parts in the conventional case, the sliding resistance is greatly decreased when valve element 9 is moved and controlled and a smooth movement of valve element 9 is ensured, and the opening and closing operation of valve part 11 is carried out at a high accuracy by well following the variation of the electromagnetic force or the suction pressure. Therefore, a more smooth and stable high-reliability control of displacement for discharge may become possible. Further, because valve element 9 is supported at upper and lower parts substantially with two-point suspension, the supporting formation for making a rod slide may become stable.

Further, because gap 14 between the inner circumferential surface of partition wall 15 and the outer circumferential surface of valve element 9 is formed as a fixed orifice, it is not necessary to provide the fixed orifice at another place, and as compared with the conventional structure, it becomes possible to simplify, in particular, the processing of the cylinder block and the vicinity thereof, and further, it is possible to simplify the processing of the compressor as a whole and to reduce the cost thereof.

Figure 3:
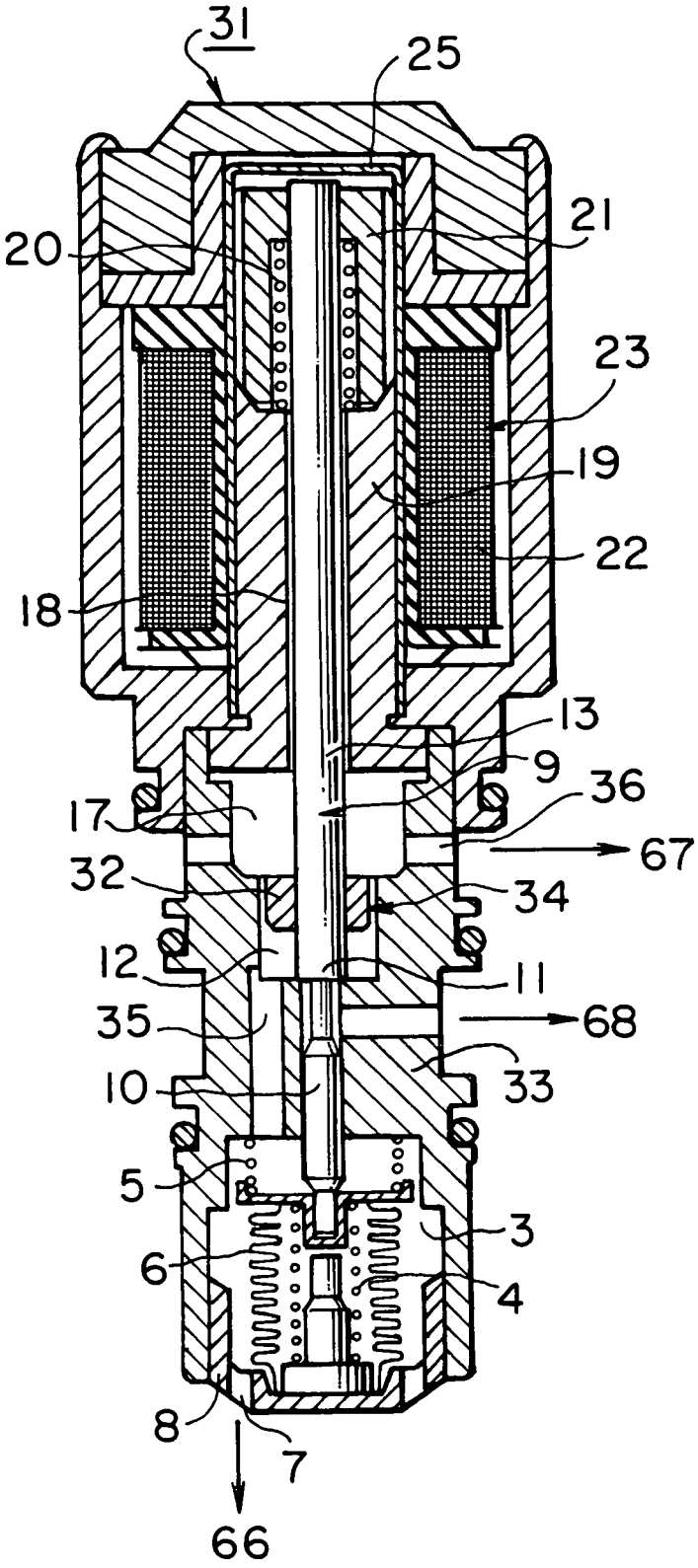
FIG. 3 is a vertical sectional view of a portion of a displacement control valve of a variable displacement compressor according to a second embodiment of the present invention.
Figure 4:
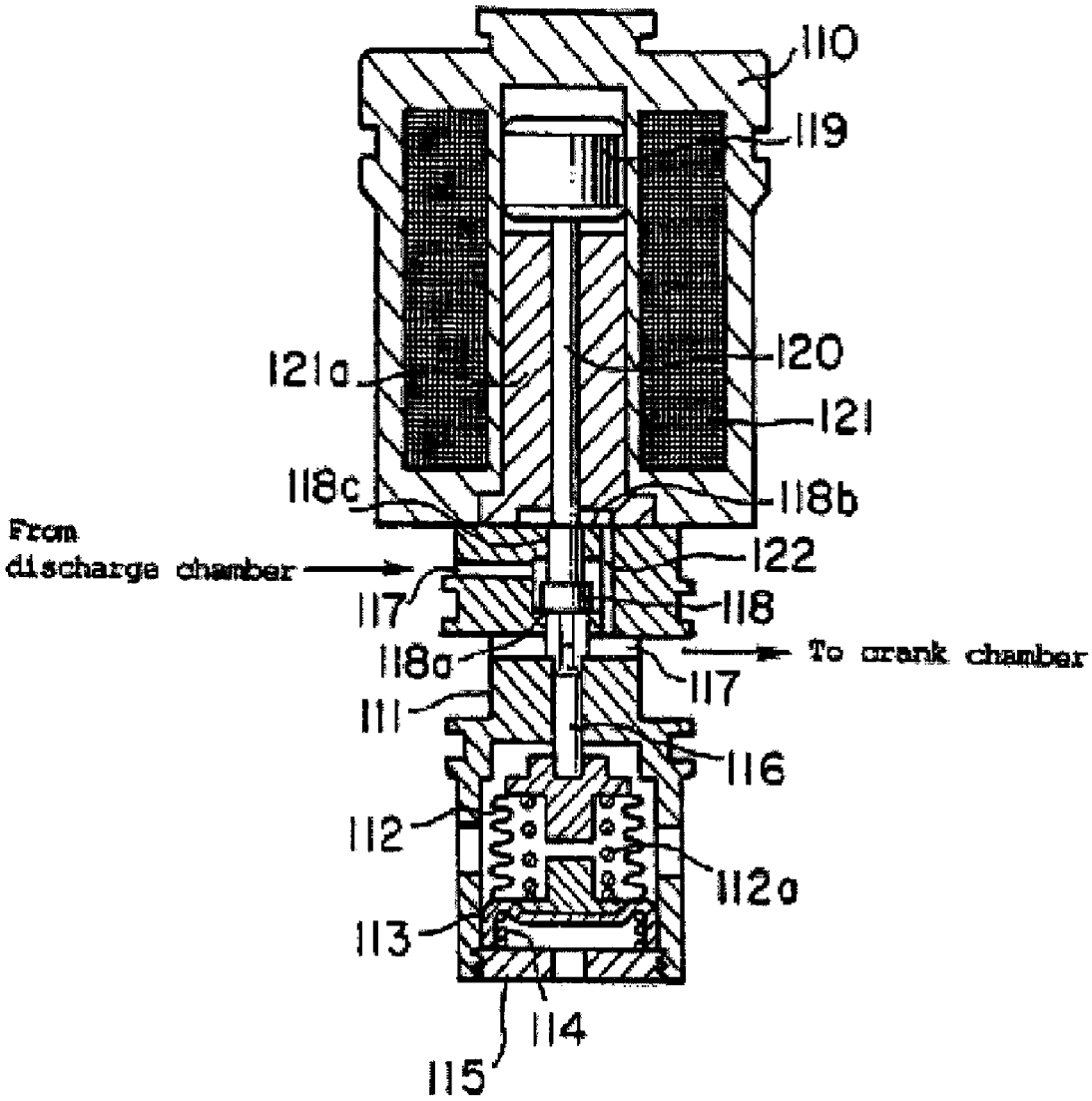
FIG. 4 is a vertical sectional view of a portion of a displacement control valve of a conventional variable displacement compressor.

FIG. 3 depicts a displacement control valve 31 of a variable displacement compressor according to a second embodiment of the present invention. In this embodiment, a partition wall 32 for partitioning between valve chamber 12 and pressure chamber 17 is fixed to valve element 9, for example, by press fitting, and a gap 34, which forms a flow passage from valve chamber 12 to pressure chamber 17 and forms a non-contact structure that does not give a sliding resistance relative to the movement of valve element 9 in its axial direction, is formed between the outer circumferential surface of partition wall 32 and the inner circumferential surface of valve casing 33 of displacement control valve 31. This gap 34 forms a fixed orifice. Further, pressure sensing chamber 3 containing bellows 6 communicates with communication passage 66 communicating to crank chamber 55 so that bellows 6 senses the pressure in the crank chamber. Valve chamber 12 communicates with pressure sensing chamber 3 through communication passage 35, thereby introducing the pressure in the crank chamber into valve chamber 12. Pressure chamber 17 communicates with communication passage 67 communicating to suction chamber 65 through communication passage 36, and the surface of pressure chamber 17 side of partition wall 32 is formed as a pressure receiving surface of the suction chamber side. Gap 34 is disposed between pressure chamber 17 and valve chamber 12 introduced with the pressure of the crank chamber side, as a fixed orifice provided on the way of a pressure relief passageway. The other structures are substantially the same as those depicted in FIG. 2, and the explanation of those structures is omitted by giving FIG. 3 the same labels as those of FIG. 2.

In displacement control valve 31 thus constructed, although bellows 6 senses the pressure in the crank chamber, by enlarging the area for receiving the suction pressure of partition wall 32 moved together with valve element 9, the bellows operates to expand and contract substantially in response to the suction pressure, thereby moving and controlling valve element 9 in its axial direction, and a similar control to that in displacement control valve 1 depicted in FIG. 2 may be possible.

Also in this displacement control valve 31, valve element 9 is supported movably by totally two sliding parts of a lower-end side sliding part between valve casing 33 and transmission rod 10 and an upper-end side sliding part between plunger 21 fixed to valve element 9 and tubular member 25. The number of sliding parts is greatly reduced as compared with the conventional number and the sliding resistance is greatly decreased, and a smooth movement of valve element 9 is ensured, and a smooth and stable high-reliability control of displacement for discharge may become possible.

Further, because gap 34 between the outer circumferential surface of partition wall 32 and the inner circumferential surface of valve casing 33 is formed as a fixed orifice, it is not necessary to provide the fixed orifice at another place, and as compared with the conventional structure, it becomes possible to simplify, in particular, the processing of the cylinder block and the vicinity thereof, and further, it is possible to simplify the processing of the compressor as a whole and to reduce the cost thereof.

INDUSTRIAL APPLICATIONS OF THE INVENTION

In the present invention, a variable displacement compressor suitable for use in an air conditioning system for vehicles, etc. can be provided, and especially, a variable displacement compressor, in which a smooth and high-reliability operation can be carried out at the portion of the displacement control valve and the processing of which can be simplified as a whole, may be provided.

The invention claimed is:

1. A variable displacement compressor having a discharge chamber, a suction chamber and a crank chamber, said compressor comprising a displacement control valve disposed at a position in a discharge pressure supply passageway capable of communicating with said crank chamber from said discharge chamber, and a fixed orifice provided at a position in a pressure relief passageway communicating with said suction chamber from said crank chamber, said displacement control valve being controlled in opening/closing operation to regulate a pressure in said crank chamber to control a piston stroke, wherein said displacement control valve further comprises a pressure sensing member being expanded and contracted by sensing a pressure in said suction chamber or said crank chamber, a valve element one end of which is brought into contact with said pressure sensing member and which has a valve part opening and closing a valve hole formed in said discharge pressure supply passageway in response to an expansion/contraction of said pressure sensing member, a valve chamber in which said valve part is disposed and to which a pressure in said crank chamber acts, a fixed partition wall disposed around said valve element at a position in an axial direction of said valve element, a pressure chamber which is partitioned from said valve chamber by said fixed partition wall and to which a pressure in said suction chamber acts, and a solenoid provided to the other end of said valve element and capable of controlling an opening degree of said valve part by increase/decrease of an electromagnetic force, and said pressure relief passageway from said valve chamber to said pressure chamber is formed by a gap between said fixed partition wall and said valve element for forming a non-contact structure which does not give a sliding resistance relative to a movement of said valve element in its axial direction, wherein said pressure relief passageway continuously is open.

2. The variable displacement compressor according to claim 1, wherein said gap forms said fixed orifice.

3. The variable displacement compressor according to claim 1, wherein said fixed partition wall is fixed at a valve casing side of said displacement control valve, and said gap is defined between an inner circumferential surface of said fixed partition wall and an outer circumferential surface of said valve element.

4. The variable displacement compressor according to claim 1, wherein said fixed partition wall is fixed to said valve element, and said gap is defined between an outer circumferential surface of said fixed partition wall and an inner circumferential surface of a valve casing of said displacement control valve.

5. The variable displacement compressor according to claim 1, wherein said solenoid comprises an electromagnetic coil excited for generating an electromagnetic force, a fixed iron core for generating a magnetic force by excitation of said electromagnetic coil, and a plunger attracted and moved to fixed iron core side by said magnetic force of said fixed iron core, the other end of said valve element is fixed to said plunger, said plunger is held slidably in an axial direction of said valve element, and a gap is defined between said fixed iron core and said valve element for forming a non-contact structure which does not give a sliding resistance relative to a movement of said valve element in its axial direction.

* * * * *